United States Patent [19]

Dubost

[11] Patent Number: 4,610,735

[45] Date of Patent: Sep. 9, 1986

[54] METHOD OF MODULATED COOLING TO MINIMIZE DEFORMATION OF FLAT METALLURGICAL PRODUCTS

[75] Inventor: Bruno Dubost, Saint-Egreve, France

[73] Assignee: Cegedur Societe de Transformation de l'Aluminium Pechiney, Paris, France

[21] Appl. No.: 655,546

[22] Filed: Sep. 28, 1984

[30] Foreign Application Priority Data

Sep. 29, 1983 [FR] France ..... 83 15823

[51] Int. Cl.[4] ..... C21D 1/18

[52] U.S. Cl. ..... 148/128; 148/143; 148/153; 148/155

[58] Field of Search ..... 148/128, 143, 153, 155, 148/156

[56] References Cited

U.S. PATENT DOCUMENTS 4,440,584 4/1984 Takeshige et al. ..... 148/128

FOREIGN PATENT DOCUMENTS 74301 1/1981 Japan .

41317 8/1982 Japan ..... 148/143

759165 8/1980 U.S.S.R. .

*Primary Examiner*—Christopher W. Brody

*Attorney, Agent, or Firm*—Oblon, Fisher, Spivak, McClelland & Maier

[57] ABSTRACT

The invention concerns a method for minimizing deformation during rapid cooling of flat metallurigcal products such as sheets, strips, flattened portions, wide sections and the like.

The method comprises rapidly cooling the product by means of a fluid (or mixtures of fluids) at temperature $T_F$, comprising at least one vaporizable liquid, with modulation in a direction perpendicular to the direction of advance of the product, so as to impart different cooling speeds to the edges and the axis (case I) or to one edge and the other (case II).

The technique may be completed by careful masking of the cooling in the zone for the rapid cooling action, or by controlled precooling prior to said rapid cooling.

The method makes it possible to obtain the rapid cooling which is necessary e.g. in quenching operations, while at the same time minimizing the deformations or the internal stress level of flat products.

10 Claims, 5 Drawing Figures

METHOD OF MODULATED COOLING TO MINIMIZE DEFORMATION OF FLAT METALLURGICAL PRODUCTS

BACKGROUND OF THE INVENTION

1. Field of the Invention

The invention concerns a method of minimising deformation during rapid cooling of flat metallurgical products, such as sheets, strips, flattened portions, wide sections and the like.

2. Discussion of the Background

Many methods and arrangements have been published in the technical literature, as a means of resolving the problem of macroscopic deformation of flat products on cooling, particularly in continuous production lines giving thermal treatment, such as annealing, quenching and the like.

The normal practice in continuous cooling of strips, sheets, wide sections and the like made of metal, is to cool a product at uniform temperature, by sprinkling or spraying it with one or more fluids, in a zone of rectangular shape, where the front for the action is perpendicular to the direction of displacement of the product, which coincides with its length; cooling is generally carried out on both surfaces of the product, with a constant delivery rate per area (expressed as an important volume of fluid of product per unit of area and of time), but it may also be unilateral.

This practice usually leads to serious deformation of the products and the deformation increases when the speed of cooling and/or the width of the product increase and/or if the speed at which the products advance is reduced. Particularly in the case of quenching metals and alloys, the quenching deformations appear immediately downstream of the front for the action of the fluid, within the range of the highest temperatures where the yield strength of the metal is excessively low; the amplitude of the deformations may be such that they impair the homogeneity of cooling and prevent its normal progress in the installation; in particular, degradations in the surface state due to friction may appear.

Reducing these permanent distortions of the products when the cooling process is over entails either a very high speed of advance (and thus cooling zones which are excessively long and excessively expensive) or, in all cases, final smoothing, planing and detensioning operations by mechanical means (rolling mill, planing machine with rollers or working by traction) which increase the cost of production.

In addition detensioning by controlled traction is necessary for products which have to have a very low residual stress level.

One of the most recently recommended means of avoiding distortion on cooling is taught by U.S. Pat. No. 4,270,959 and uses a method of cooling metal strips with blown air, in such a way that the temperature of the lateral zones of the strip is below that of the central zone throughout the cooling process.

However, this process is not suitable for rapid cooling, where a cooling fluid or a mixture of cooling fluids including at least one vaporizable liquid such as water has to be used, both from the metallurgical point of view (inadequate cooling speed) and from the point of view of permanent deformation after cooling.

SUMMARY OF THE INVENTION

The method of the invention overcomes these difficulties. It consists of cooling the product rapidly with a fluid (or mixture of fluids) at temperature $T_F$, including at least one vaporizable liquid. The cooling ation is modulated, in a direction perpendicular to the direction of displacement of the product, between the initial temperature of the product $T_O$ and $T_F$.

In cases where cooling is symmetrical with the axis of progression of the product (case (I)), modulation is applied between the axis of progression and the edges. In the case of asymmetric cooling (case (II)) modulation is applied between the two edges. In both cases modulation is such that the cooling curves for the points located on a line perpendicular to the axis of displacement intersect in a temperature zone included between $T_S=\frac{1}{3}(2To+T_F)$ and $Ti=\frac{1}{3}(To+2T_F)$. Thus the temperatures of the central zones (case (I)) or of one edge (case II) remain below those of the edges (case I) or of the other edge (case II), at least within the range of temperatures between To and Ts, while establishing a monotonic temperature gradient between the edges and the centre (case I) or between the two edges (case II). Modulation of the cooling action may be obtained, for example, by locally varying the delivery rate of fluid per area and/or by locally varying the composition or nature of the fluid.

As a result the intensity of cooling, expressed eg. as the delivery rate of cooling fluid per area at a given temperature, generally ambient temperature, which is kept substantially constant along zones parallel with the axis of the product, gradually decreases from the edges towards the axis of the product (case I) or from one edge to the other (case II).

Tests have shown that, in order to obtain minimal deformation, the optimum speed of progression depends on the average cooling speed within the ranges $T_S$–Ti, on the width of the product and on the distance between the cooling speed at the edge and that at the centre (caseI) or between those at the edges (case II).

Two main methods have been used thus to improve inherent flatness, the methods being used either separately or in combination.

1. The first method consists of preventing rapid cooling in specific zones of the product, by forming a front for angular (case I) or oblique (case II) cooling action, e.g. by means of masks or sprinkling ramps in an appropriate geometrical arrangement, the temperature of the product being uniform before cooling, and the cooling process being rapid and in accordance with the above mentioned features of the invention.

In this first embodiment and in a first approximation, the prohibited zone has the shape of one (case II) or two (case I) right angle isosceles triangles, where the apices of the angle of 45° are located on the axis of the strip (point O) and where the adjacent sides are perpendicular to that axis and located downstream of the point O in the direction of progression.

In a preferred embodiment of the prohibited zone has the shape of one (case II) or two (case I) right angled "triangles" in which the curved "hypotenuse" has a concavity directed towards the right angled apex of the triangle and tangent at O to the hypotenuse of the basic isosceles triangle. This curve intersects the side of the triangle parallel with the axis of progression of the product at a distance between 0.6 and 1.0 times the width (case II) or half the width (case I) of the product, counted from the apex of the right angle.

2. The other solution is to carry out local pre-cooling of the product, lowering the temperature of the axial zone relative to the lateral zone (case I) or lowering that of one edge zone relative to the other (case II), before the final drastic cooling, where the action is then on a straight transverse front.

In this second embodiment it is sufficient to lower the temperature of the stated zones of the product so as to bring the temperature difference between the edges and the axis (case I) or between the edges themselves (case II) to ΔTo, before the final cooling according to the invention, the action then being on a purely transverse front.

The value of ΔTo is substantially equal to:

$$(k-1)\frac{To-TF}{2}$$

in which formula K (K>1) represents the ratio of the average cooling speed of the edges to that of the axis (case I) or those of the edges to one another (case II) within the temperature range between Ts and Ti.

The two methods can equally be used simultaneously. Firstly, the front for the rapid cooling action is given the shape of one (case II) or two (case I) curved right angled triangles forming an angle $\alpha°$ Intersecting the edge or edges at a distance from the apex of the right angle substantially equal to:

$$K\frac{L}{2}\,tg\alpha \qquad \text{(case I)}$$

or $$KLtg\alpha \qquad \text{(case II)}$$

L being the width of the product with $0.6 \leqq K \leqq 1$ and $0 \leqq \alpha \leqq 45°$.

And secondly, the product is cooled at a preliminary stage to bring the temperature difference between the edges and the axis (case I) or between the edges themselves (case II), counted at the front for the action, substantially to:

$$\Delta T_o = (k-1)\frac{T_o - T_F}{2}\left(1 - \frac{\alpha}{45}\right)$$

$\alpha$ being expressed in degrees.

DETAILED DESCRIPTION OF THE PREFERRED EMBODIMENTS

Figure 1:
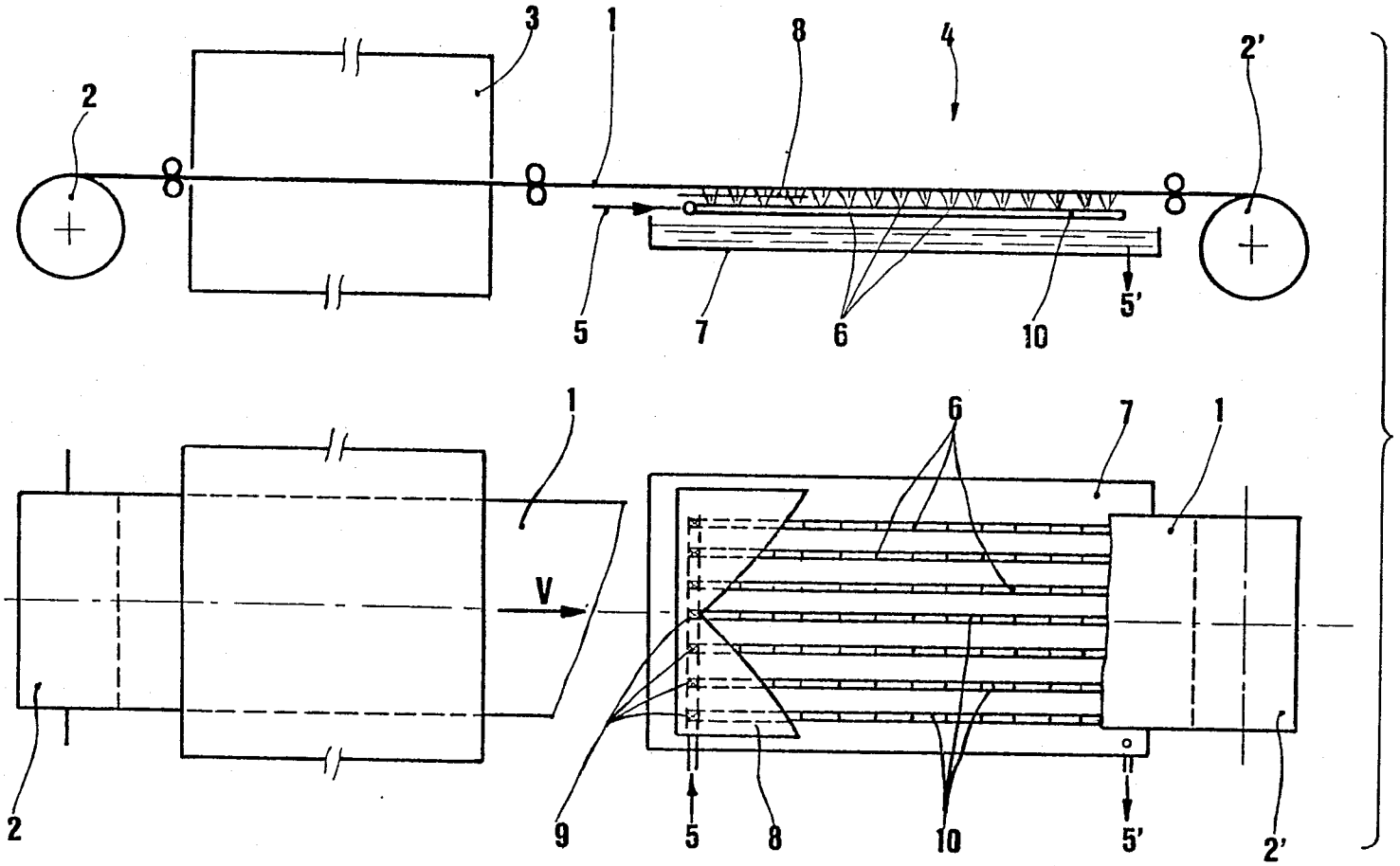
FIG. 1 is an elevation and a plan view of a unilateral cooling installation which enables the method of the invention to be applied to a continuously treated horizontal metal strip.

In FIG. 1 a metal strip 1 in the form of a coil 2 is unwound and passes into a reheating furnace 3, then into a cooling installation 4 before being rewound on a reel 2'; the installation obviously includes the drive means and supports for the strip 1 (not shown).

The cooling installation comprises an inlet 5 for pressurized fluid (liquid or gas), which is distributed over the whole surface of the strip 1 by means of nozzles or jets 6. The delivery rate of the nozzles or jets can be controlled on each of the feed mechanisms 10 parallel with the direction of displacement (V) of the strip 1, for example by means of adjustable valves 9. The fluid is recovered in a tank 7 and returned to the compressing or circulating means (not shown), possibly after cooling, via the pipe 5'. The delivery rate increases systematically and progressively from the axial to the lateral feed mechanisms.

The cooling system is provided with a mask 8 at the place where the strip 1 enters the cooling arrangement 4. The mask is located between the strip 1 and the jets 6 and has the shape shown in the figure, thus obstructing part of the sprinkling means.

Although FIG. 1 only shows a method of cooling the strips unilaterally, bilateral cooling is of course possible, and it is also possible to vary the intensity of cooling lengthwise of each ramp.

Figure 2:
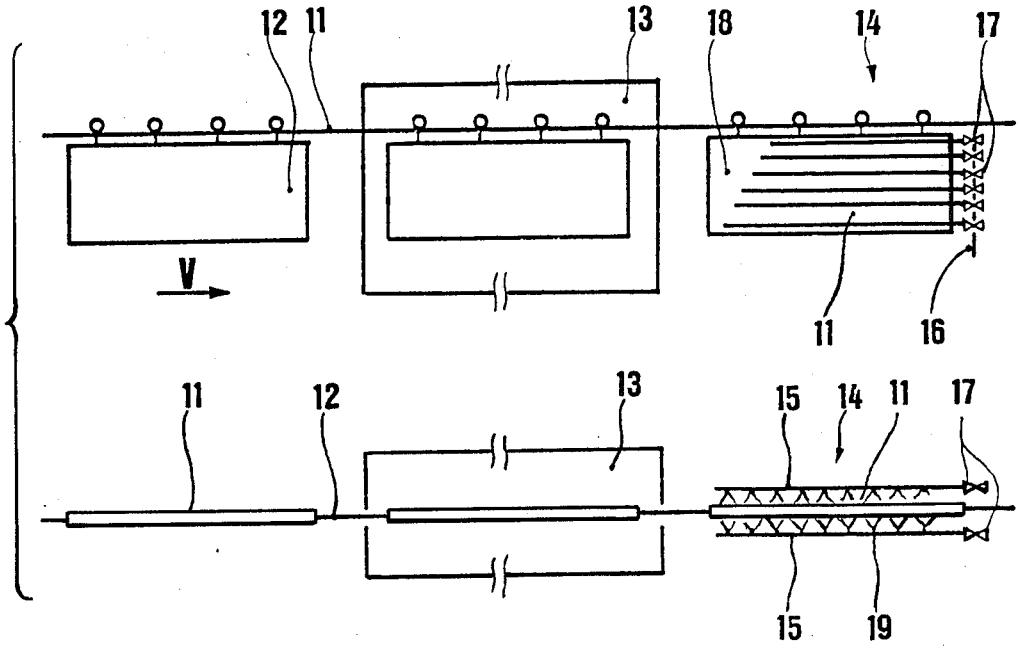
FIG. 2 is an elevational and a plan view of a bilateral cooling installation which enables the method of the invention to be applied to the treatment of a sequence of metal sheets in a vertical position.

In FIG. 2 vertical sheets of metal 11 advance at a speed (V), suspended from a transporting means 12 of the monorail type. They pass successively into the heating furnace 13 and the cooling system 14. The latter has a series of horizontal feed mechanisms 15, fitted with water spraying nozzles 19 which are located symmetrically on both sides of the sheet of metal 11. The nozzles are supplied by the inlet tube 16 by means of adjustable valves 17. The feed mechanisms and nozzle cover the surface of the sheet apart from a sector 18 of the shape indicated. The zone which is cooled first is thus that at the bottom edge of the sheet, the purpose being to avoid trouble caused by the cooling fluid trickling over the sides of the sheet 11.

The fluid delivery rate is modulated in each feed mechanism and decreases evenly from the top of the sheet to the bottom.

Figure 3:
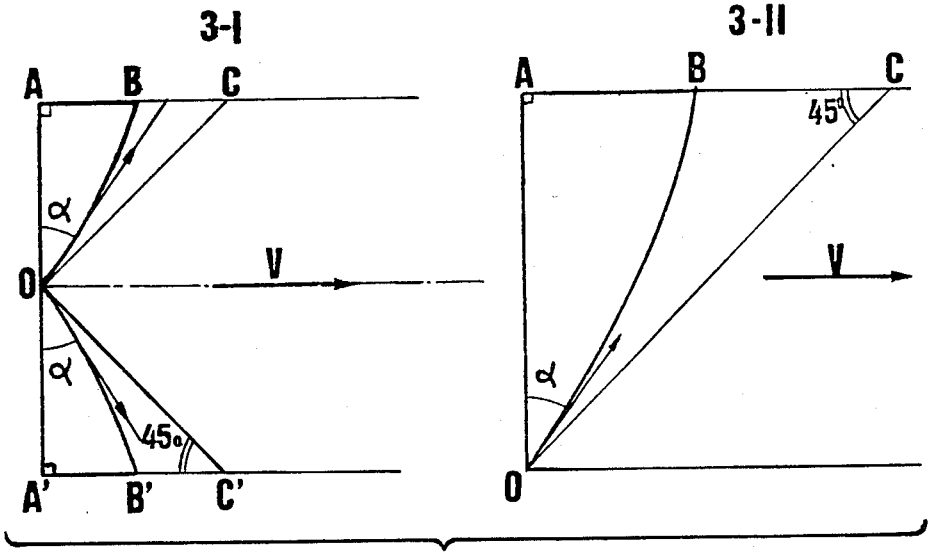
FIG. 3 is a detail showing the shape of the prohibited cooling zones, in the case of symmetrical cooling (3-I) or asymmetrical cooling (3-II)

FIG. 3 shows in greater detail the shape of the prohibited cooling zone in the case of symmetrical cooling (FIG. 3-I) or asymmetrical cooling (FIG. 3-11). The triangles OAC and OA'C' are right angled isosceles onces. The surfaces OAB, OA'B' have the shape of right angles triangles in which the curved "hypotenuse" forms an angle $\alpha \leqq 45°$ with OA or AA'; the concavity of the curved line faces towards the apex of the right angle (A or A') and its length AB=A'B' is given in the above text.

FIG. 4 is a temperature-distance diagram showing the cooling curves for a strip 1 at various positions: at the edges (curve E), at the centre (curve C) and at one quarter of the width (curve Q) from the initial temperature ($T_o$). Cooling is modulated within the width of the strip, in such a way that the curves intersect substantially at the temperature To, located between $\frac{1}{3}(2\text{To}+T_F)$ and $\frac{1}{3}(\text{To}+2T_F)$.

Figure 4A:
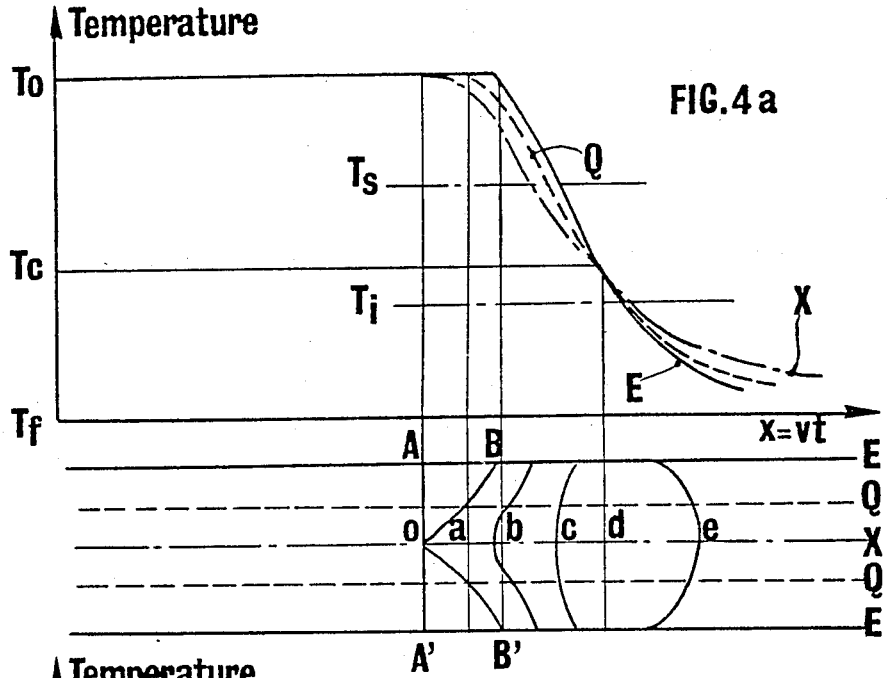
FIG. 4*a* shows the distribution of isotherms when the first embodiment is carried out.

In FIG. 4*a* the masks have the shape of two curved right angled triangles OAB and OA'B', located downstream of the point O, which makes the beginning of cooling on the axis of the strip. The isotherms on the strip have the shapes shown on curves (a)=B'OB, (b), (c), (d), corresponding to $T_c$, (e), etc.

Figure 4B:
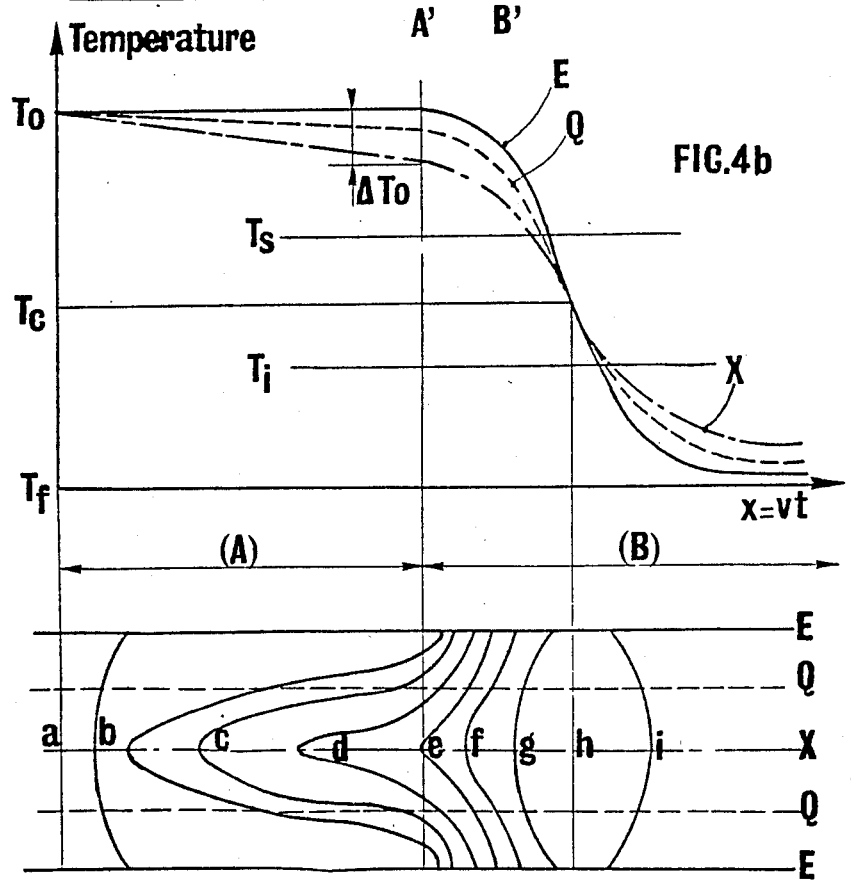
FIG. 4*b* shows the distribution of isotherms when the second embodiment is carried out, with preliminary cooling.

In FIG. 4*b* a pre-cooling zone A is provided before the proper cooling zone B; in the zone A cooling at the axis of the product is accelerated relative to the edges, giving the isothermic curves shapes such as (a), (b), (c), (d). This is done by modulating the delivery rate of cooling nozzles, supplied e.g. with cold air, in the direction of the width. The cooling of part B is similar to that in FIG. 4*a*. The isotherms are shown as (f), (g), (h), corresponding to Tc, (i), etc.

EXAMPLE 1

We horizontally quenched a sequence of thin sheets, measuring 620×350×3.2 mm, of aluminium alloy 2024, after it had been taken into solution for 30 minutes at 495° C. in a ventilated furnace, by mechanically spraying the sheets with water.

The experimental installation comprised, downstream of the furnace:

a zone for moderately pre-cooling the axial zone of the sheet (midway across the width) by unilaterally spraying water onto the lower surface of the sheet, by means of one or two nozzles of small diameter (diameter=1.15 mm—type A) centred on the longitudinal axis of the sheets (in the direction of their advance), and allowing for the central zone to be pre-cooled relative to the edges of the sheet where appropriate.

a zone for rapid cooling (or quenching in the case of alloy 2024) equipped with longitudinal spray ramps located on both sides of a carriage designed to support and horizontally translate the sheets at a variable speed of progression V, so as to simulate horizontal quenching (on the lower surface of the sheets) or bilateral (symmetrical) quenching of the sequence leaving runing furnace. The longitudinal ramps were equipped with mechanical sprays with jets in the form of a full cone with an angle of 60° and with nozzle diameters of 1.15 mm (type A nozzles), 1.95 mm (type B nozzles), 2.20 mm (type C nozzles) or 2.45 mm (type D nozzles). The nozzles were adjusted to allow for transverse modulation of the cooling action, in the case of the invention, characterised by monotonic evolution of the temperature between the edges of the sheet and the axis thereof (corresponding to case I previously described).

The ramps were supplied with mains water at ambient temperature (Tf=20° C.) at a pressure of 2.5 bars, thus making it possible to obtain average cooling speeds from about 55° C./sec. (type A nozzles) to 160° C./sec. (type D nozzles) with the various types of nozzles used.

Allowing for the time for handling the sheets between the furnace and the cooling installation, the sheets had a substantially uniform temperature of about 480° C. at the beginning of the pre-cooling or rapid cooling operation.

The front for the rapid cooling action was bounded by a mask which was either straight and transverse (perpendicular to the direction of progression of the sheets parallel with their axis), or angular according to the invention (case I) with an angle $\alpha$ between the transverse direction of the sheets and the curved "hypotenuse", the length of the mask along the edge of the sheet being equal to K times the half width of the sheets.

Deformations of the sheets were observed during rapid cooling, and the persistent longitudinal deformations (camber or amplitude of undulations in sheets) were measured after quenching.

Table I below gives the test conditions according to normal procedures or according to the invention and the deformation levels obtained on the sheets. In particular it gives the position of the range of temperatures where the cooling curves for the edges and for midway across the width intersect, relative to the range preferred in the invention, which must in this case be between $Ts=\frac{1}{3}(2To+Tf)=327°$ C. and $Ti=\frac{1}{3}(To+2Tf)=173°$ C.

The results obtained show that sheets quenched in accordance with normal practice (tests no. 1 or 3) or by a cooling method which encourages a decrease in temperature at the edges relative to that in the zone midway across the width of the sheet, in the high temperature range (test no. 4), are very greatly deformed during rapid cooling and retain a marked camber after quenching, usually associated with warping which makes it difficult to straighten them.

On the other hand, sheets treated in accordance with the invention (tests nos. 2, 6, 8 and 9) by transverse modulation of the cooling action, by means of longitudinal ramps fitted with nozzles which give higher water delivery rates at the edges than at the centre, associated with pre-cooling of the axisl zone and/or associated with a front defined in accordance with the invention, give rise to only slight permanent deformation during cooling, if the range of intersection between temperatures at the edges and temperatures midway across the width is really between temperature Ts and temperature Ti.

EXAMPLE 2

We quenched sheets measuring 700×350×8 mm of aluminium alloy 7075, in accordance with conventional methods or in accordance with the invention in case II previously described.

In the experimental installation the sheets progressed vertically at 10 cm/sec. on a horizontal rail parallel with the longitudinal edge of the sheet, the top edge of the sheet being hooked onto the rail by means of clips.

After being taken into solution for 45 minutes at 475° C., the sheets were brought rapidly by horizontal translation into the quenching zone, comprising four horizontal longitudinal ramps which were superimposed in a vertical plane and located symetrically on both sides of the plane of the sheet. The initial temperature $T_o$ of the sheets entering the rapid cooling zone was substantially uniform in all the sheets and close to 405° C. The ramps were equipped with nozzles for mechanically spraying mains water at a temperature Tf of 20° C. and a pressure of 4 bars, of diameters similar or different from one ramp to another, in the transverse direction of the sheets, and identical with the nozzles A,B,C and D described in example 1 above.

The staggering of the ramps along their longitudinal axis and the use of a mask on both sides of the sheet made it possible to define a quenching aperture which was either rectangular or parallelepipedal (in the case of normal practice) or with a curved inclined front, with a curved front for water action at an angle $\alpha$ of 45° to the vertical, and intersecting the upper edge at a distance equal to K times the width of the sheet (dimension perpendicular to its direction of advance).

Table II below give the arrangements of ramps and nozzles used (from the upper to the lower edge) and the cooling conditions obtained (average cooling speed—temperature of intersection of cooling curves), measured by thermo-couples located midway across the thickness in the vicinity of the upper and lower edges.

The conditions for cooling the central zones (between edges) obviously come between those for the edges.

Transverse modulation of cooling under the conditions of the invention, that is to say, with a range of intersection between the temperature evolution curves for the edges between Ts=317° C. and Ti=168° C. (test 3), is found considerably to improve the inherent flatness of sheets as compared with that of sheets quenched in the normal fashion (test 1 or 2) or under bad conditions (test 4), while also maintaining high cooling speeds on average throughout the sheet.

TABLE I

COOLING CONDITIONS AND DEFORMATION OF SHEETS 620 × 350 × 3.2 mm MADE OF 2024 ALLOY

| | | | PRECOOLING | | RAPID COOLING CONDITIONS | | | | |
|---|---|---|---|---|---|---|---|---|---|
| Test | Quenching configuration | Speed of progression (cm/sec) | Midway across width | Δ TO (°C.) | Front for action | Position of ramps | Type of nozzles | k | Range of temperatures T at intersection of cooling curves for edges & centre |
| 1 | Bilateral (symmetrical) | 8 | — | 0 | Straight (tranverse) | Edges mid width | B B | 1.0 | — |
| 2 | Bilateral (symmetrical) | 8 | — | 0 | Angular ($\alpha$45°-K = 0.8) | Edges mid width | C A | 2.0 | $Ti < T_n < Ts$ (acc. to invention) |
| 3 | Unilateral (on bottom surface) | 10 | — | 0 | Straight (transverse) | Edges mid width | C C | 1.0 | — |
| 4 | Unilateral (On bottom surface) | 10 | — | 0 | Straight (transverse) | Edges mid width | D B | 1.6 | $Ts < T_n = TO$ |
| 5 | Unilateral (on bottom surface) | 10 | — | 0 | Angular ($\alpha$45°-K = 1) | Edges mid width | C C | 1.0 | $T_n < Ti$ |
| 6 | Unilateral (on bottom surface) | 10 | — | 0 | Angular ($\alpha$45°-K = 0.85) | Edges mid width | D B | 1.6 | $Ti < T_n < Ts$ (acc. to invention) |
| 7 | Unilateral (On bottom surface) | 10 | — | 0 | Angular ($\alpha$45°-K = 0.6) | Edges mid width | D A | 3.0 | $T_n > Ts$ |
| 8 | Unilateral (on bottom surface) | 12 | 2 nozzles type A | 55 | Straight (transverse) | Edges mid width | C B | 1.25 | $Ti < T_n < Ts$ (acc. to invention) |
| 9 | Unilateral (on bottom surface) | 12 | 1 nozzle type A | 25 | Angular ($\alpha$45°-K = 0.95) | Edges mid width | C B | 1.25 | $Ti < T_n < Ts$ (acc. to invention) |

| | DEFORMATIONS OF SHEET | |
|---|---|---|
| TEST | During cooling | Maximum permanent deformation (mm) |
| 1 | Very great | Undulations 40 mm |
| 2 | Slight | Undulations 9 mm |
| 3 | Definite curve | Camber + 33 mm |
| 4 | Definite curve | Camber + 26 mm |
| 5 | Definite curve | Camber − 22 mm |
| 6 | Slight curve | Camber + 7 mm |
| 7 | Definite curve | Camber − 42 mm |
| 8 | Slight curve | Camber − 5 mm |
| 9 | Slight curve | Camber + 6 mm |

TABLE II

COOLING CONDITIONS AND DEFORMATIONS OF SHEETS 720 × 350 × 8 mm MADE OF ALLOY 7075, QUENCHED ON BOTH FACES IN VERTICAL PROGRESSION (CASE II)

| TEST | FRONT FOR ACTION | POSITION OF RAMP | TYPE OF NOZZLE | AVERAGE COOLING SPEED (°C./sec) | RANGE OF INTERSECTION OF TEMPERATURES BETWEEN EDGES (°C.) | PERMANENT DEFORMATION OF SHEETS AFTER QUENCHING |
|---|---|---|---|---|---|---|
| 1 | Vertical | Top edge | C | 115 | 420° C. | Considerable (max. camber 12 mm) |
| | | Top ¼ width | C | not measured | | |
| | | Bottom ¼ width | C | not measured | | |
| | | Bottom edge | C | 128 | | |
| 2 | Inclined straight ($\alpha$45° − K = 1) | Top edge | C | 118 | 460° C. | Considerable (max. camber 8 mm) |
| | | Top ¼ width | C | not measured | | |
| | | Bottom ¼ width | C | not measured | | |
| | | Bottom edge | C | 137 | | |
| 3 | Inclined curve, concavity towards furnace ($\alpha$ = 45° − K = 0.85) | Top edge | D | 163 | 260° C. (invention) | Very slight (max. camber 1 mm) |
| | | Top ¼ width | C | not measured | | |
| | | Bottom ¼ width | B | not measured | | |
| | | Bottom edge | A | 72 | | |
| 4 | Inclined curve concavity inverted | Top edge | D | 170 | 460° C. | Very considerable (camber 25 mm) |
| | | Top ¼ width | C | not measured | | |
| | | Bottom ¼ width | C | not measured | | |

TABLE II-continued

| COOLING CONDITIONS AND DEFORMATIONS OF SHEETS 720 × 350 × 8 mm MADE OF ALLOY 7075, QUENCHED ON BOTH FACES IN VERTICAL PROGRESSION (CASE II) | | | | | | |
|---|---|---|---|---|---|---|
| TEST | FRONT FOR ACTION | POSITION OF RAMP | TYPE OF NOZZLE | AVERAGE COOLING SPEED (°C./sec) | RANGE OF INTERSECTION OF TEMPERATURES BETWEEN EDGES (°C.) | PERMANENT DEFORMATION OF SHEETS AFTER QUENCHING |
| | ($\alpha$ = 45° − K = 1.25) | Bottom edge | B | 93 | | |

I claim:

1. A method for rapidly and continuously cooling a flat metallurgical product, having a longitudinal axis, at an initial and substantially uniform temperature $T_O$, to minimize deformation of said product, which comprises contacting said flat metallurgical product with at least one vaporizable fluid, at an initial temperature $T_f$, on a zone comprised between a starting front having an origin, O, and a trailing edge, on one or both sides of the product, said cooling being modulated in the transverse direction to the length of the product, whereby cooling curves for points located on the same transverse direction intersect in a temperature range comprised between $T_s=\frac{1}{3}(2T_O+T_f)$ and $T_i=\frac{1}{3}(T_O+2T_f)$, the temperature of the axis remaining below that of the edges, at least within the temperature range $T_O$–$T_s$ and remaining over, at least within the temperature range $T_i$–$T_f$.

2. The method of claim 1, wherein said cooling is modulated so as to create a monotonic temperature gradient between the edges and the axis of the product.

3. The method of claim 1, wherein for said product cooled rapidly from its temperature $T_O$, the front for the rapid cooling action has a curved shape, with the concavity turned upstream relative to the direction of progression of the product and is located in two right angled isosceles triangles.

4. The method of claim 1, wherein before said rapid cooling the product undergoes moderate precooling, imparting a monotonic decrease in temperature between the edges and the axis, giving rise, at right angles to the front for the rapid cooling action, to a temperature difference between the edge and the axis substantially equal to:

$$\Delta T_O = (k-1)\frac{T_O - T_f}{2}\left(1 - \frac{\alpha}{45}\right)$$

wherein k ($k \geqq 1$) is the ratio of average cooling speeds between the edges and the axes within the temperature range between $T_s$ and $T_i$, and $\alpha$ is the angle (in degrees) between the tangent of the origin, O, of the front for the action and a line perpendicular to the direction in which the product advances.

5. The method of claim 1, wherein the front for the action intersects the edges of the product at a distance counted from the origin of the rapid cooling action substantially equal to:

$$K\frac{L}{2}\tan\alpha$$

with $$0.6 \leqq K \leqq 1$$

wherein L is the width of the product measured perpendicular to the direction to the advance.

6. A method for rapidly and continuously cooling a flat metallurgical product, having a longitudinal axis at an initial and substantially uniform temperature $T_O$, to minimize deformation of said product, which comprises contacting said flat metallurgical product with at least one vaporizable fluid, at an initial temperature $T_f$, on a zone comprised between a starting front having an origin, O, and a starting edge, on one or both sides of the product, the cooling being modulated in the transverse direction to the length of the product so that cooling curves for points located on the same transverse direction intersect in a temperature range comprised between $T_s=\frac{1}{3}(2T_O+T_f)$ and $T_i=\frac{1}{3}(T_O+2T_f)$, the temperature of one edge remaining below that of the other edge, at least within the temperature range $T_O$–$T_s$ and remaining over, at least within the temperature range $T_i$–$T_f$.

7. The method of claim 6, wherein said cooling is modulated so as to create a monotonic temperature gradient between the edges of the product.

8. The method of claim 6, wherein for said product cooled rapidly from its temperature $T_O$, the front for the rapid cooling action has a curved shape, with the concavity turned upstream relative to the direction of progression of the product and is located in one right angled isosceles triangle.

9. The method of claim 6, wherein before the rapid cooling the product undergoes moderate precooling, imparting a monotonic decrease in temperature between the edges giving rise, at right angles to the front for the rapid cooling action, to a temperature difference between the edges substantially equal to:

$$\Delta T_O = (k-1)\frac{T_O - T_f}{2}\left(1 - \frac{\alpha}{45}\right)$$

wherein k ($k \geqq 1$) is the ratio of average cooling speeds between the edges within the temperature range between $T_s$ and $T_i$ and $\alpha$ is the angle (in degrees) between the tangent of the origin, O, of the front for the action and a line perpendicular to the direction in which the product advances.

10. The method of claim 6, wherein the front for the action intersects the edge of the product at a distance counted from the origin of the rapid cooling action, substantially equal to:

$$K\frac{L}{2}\tan\alpha$$

with $$0.6 \leqq K \leqq 1.$$

* * * * *